US012096872B2

(12) United States Patent
Hatton et al.

(10) Patent No.: US 12,096,872 B2
(45) Date of Patent: Sep. 24, 2024

(54) SYSTEM AND METHOD FOR SUPPORTING A PRIVACY CURTAIN INCLUDING A SWING ARM WALL MOUNT AND END STOP CAP SUPPORT

(71) Applicant: CROMPTON VENTURES, LLC, Wilmette, IL (US)

(72) Inventors: Marc Hatton, Wilmette, IL (US); Robert Blanford, Wilmette, IL (US); Tom Fitzgerald, Wilmette, IL (US); Glen R. Platner, Wilmette, IL (US)

(73) Assignee: CROMPTON VENTURES, LLC, Wilmette, IL (US)

( * ) Notice: Subject to any disclaimer, the term of this patent is extended or adjusted under 35 U.S.C. 154(b) by 0 days.

(21) Appl. No.: 18/331,581

(22) Filed: Jun. 8, 2023

(65) Prior Publication Data

US 2024/0016328 A1 Jan. 18, 2024

Related U.S. Application Data

(60) Provisional application No. 63/473,553, filed on Jun. 8, 2022.

(51) Int. Cl.
*A47H 1/122* (2006.01)
*A47H 5/09* (2006.01)

(52) U.S. Cl.
CPC ..... *A47H 1/122* (2013.01); *A47H 5/09* (2013.01)

(58) Field of Classification Search
CPC ..... A47H 1/12; A47H 1/122; A47H 1/124; A47H 1/03; A47H 1/022; A47H 5/09
See application file for complete search history.

(56) References Cited

U.S. PATENT DOCUMENTS 69,287 A * 9/1867 Weed ..... E05D 3/02 16/270
71,452 A * 11/1867 Cady ..... E05D 3/02 16/379
460,939 A * 10/1891 Tateyama ..... A47H 1/122 248/265
648,454 A * 5/1900 Deland ..... A47H 1/02 160/335
681,201 A * 8/1901 Curtis ..... A47G 25/0685 248/265
833,564 A * 10/1906 Thompson et al. ... A47H 1/022 160/128
863,547 A * 8/1907 Mansfield ..... A47H 1/122 248/265

(Continued)

*Primary Examiner* — Johnnie A. Shablack
(74) *Attorney, Agent, or Firm* — SMITH TEMPEL; Steven P. Wigmore

(57) ABSTRACT

A system for supporting a privacy curtain includes a swing arm wall mount and a swing arm that are coupled together. An end stop cap support may engage the swing arm when the swing arm is in a closed position. The swing arm wall mount allows the swing arm to rotate when the swing arm is in an open position and when the swing arm is not engaged with the end stop cap support. An end stop cap may couple with the swing arm. The end stop cap engages the end stop cap when the swing arm is in the closed position. And the end stop cap does not engage the end stop cap support when the swing arm is in an open position. The swing arm may comprise a pin at one end, wherein the pin engages the swing arm wall mount.

13 Claims, 13 Drawing Sheets

(56) References Cited

U.S. PATENT DOCUMENTS 869,787 A * 10/1907 Keith ..... A47G 25/0685 160/334
904,537 A * 11/1908 Jones ..... A47H 1/022 248/265
1,055,784 A * 3/1913 Ness ..... A47H 1/022 160/125
1,109,860 A * 9/1914 Molyneux ..... A47H 1/122 248/265
1,139,451 A * 5/1915 Walker ..... A47G 25/0685 248/261
1,168,990 A * 1/1916 Altschul ..... E06B 9/52 160/335
1,178,302 A * 4/1916 Long ..... A47H 5/09 160/337
1,204,570 A * 11/1916 Holmen et al. ..... A47H 1/022 248/265
1,298,634 A * 4/1919 Allen ..... A47H 1/022 248/265
1,333,702 A * 3/1920 Boye ..... A47H 5/09 248/265
1,374,563 A * 4/1921 Hartmeyer ..... A47H 1/022 248/265
1,398,411 A * 11/1921 Akers ..... A47H 1/022 248/265
1,405,416 A * 2/1922 Howell ..... A47H 1/022 160/92
1,435,110 A * 11/1922 Efford ..... A47H 5/09 248/265
1,436,449 A * 11/1922 Kirsch ..... A47H 5/09 211/96
1,509,098 A * 9/1924 Callender ..... A47H 1/022 248/265
1,509,639 A * 9/1924 Condon ..... A47H 1/022 160/92
1,520,265 A * 12/1924 Thibodeau ..... A47H 5/09 211/96
1,520,857 A * 12/1924 Courtois ..... A47H 5/09 248/262
1,525,533 A * 2/1925 Brown ..... A47H 5/09 248/265
1,547,860 A * 7/1925 Dangerfield ..... A47H 1/022 160/125
1,967,392 A * 7/1934 Boye ..... A47H 5/09 248/265
1,981,543 A * 11/1934 Dover ..... A47H 5/09 211/96
2,046,824 A * 7/1936 Kenney ..... A47H 1/022 160/334
2,078,076 A * 4/1937 Hines ..... E05D 3/02 16/273
2,110,598 A * 3/1938 Henry ..... A47H 1/022 160/19
2,110,671 A * 3/1938 Kirsch ..... A47H 5/09 160/19
D119,576 S * 3/1940 Kirsch ..... D8/376
2,192,882 A * 3/1940 De Muth ..... A47H 5/09 160/335
2,201,043 A * 5/1940 Kirsch ..... A47H 1/08 248/262
2,210,982 A * 8/1940 Lemle ..... A47H 1/022 248/265
2,243,724 A * 5/1941 Whitehead ..... A47H 5/09 29/897
2,298,217 A * 10/1942 Lemle ..... A47H 5/09 248/265
2,443,242 A * 6/1948 Hansen ..... A47H 1/03 248/279.1
2,461,457 A * 2/1949 Weber ..... A47H 1/022 248/265
2,469,098 A * 5/1949 Allen ..... A47H 1/022 211/105.2
2,509,521 A * 5/1950 Pegram ..... A47H 1/022 211/105.3
2,642,192 A * 6/1953 Whitney ..... A47H 5/03 211/105.1
2,855,041 A * 10/1958 Blashfield ..... A47H 1/022 5/512
2,886,105 A * 5/1959 Lee ..... B60J 5/125 160/335
3,952,369 A * 4/1976 Erickson ..... D06F 39/14 16/265
4,139,101 A * 2/1979 Towfigh ..... A47G 5/00 211/100
5,794,281 A * 8/1998 Shearon ..... A47K 3/38 4/558
D426,142 S * 6/2000 Moore ..... D8/363
D430,480 S * 9/2000 Rowan ..... D8/363
6,263,523 B1 * 7/2001 Moore ..... A47H 1/102 248/262
6,367,755 B1 * 4/2002 Arena ..... A47H 5/08 248/265
D534,062 S * 12/2006 van den Bosch ..... D8/376
7,171,705 B1 * 2/2007 Hicks ..... A47K 3/003 292/262
D542,897 S * 5/2007 Harwanko ..... D23/304
D552,455 S * 10/2007 Moore ..... D8/363
D586,647 S * 2/2009 Didehvar ..... D8/376
7,762,508 B2 * 7/2010 Xu ..... A47K 3/38 248/251
D633,780 S * 3/2011 Barrese ..... D8/363
8,069,507 B2 * 12/2011 Didehvar ..... A47K 3/38 4/610
8,166,583 B1 * 5/2012 Liang ..... A47K 3/38 4/558
8,185,981 B2 * 5/2012 Didehvar ..... A47K 3/38 4/610
8,341,775 B2 * 1/2013 Didehvar ..... A47K 3/38 4/558
8,991,625 B2 * 3/2015 Bucklew ..... A47H 1/022 211/105.3
9,033,163 B2 * 5/2015 Hsu ..... A47H 1/142 211/105.3
9,107,529 B2 * 8/2015 Didehvar ..... A47H 1/022
9,271,592 B2 * 3/2016 Didehvar ..... A47H 1/142
D975,527 S * 1/2023 Ye ..... D8/378
2004/0178310 A1 * 9/2004 Marion ..... A47K 3/38 248/251
2007/0006377 A1 * 1/2007 Moore ..... A47K 3/38 4/558
2007/0174956 A1 * 8/2007 Heaslip ..... A47K 3/38 4/558
2008/0028513 A1 * 2/2008 Didehvar ..... A47K 3/38 248/265
2009/0300838 A1 * 12/2009 Didehvar ..... A47K 3/38 4/610
2011/0192949 A1 * 8/2011 Zimmerman ..... A47H 19/00 248/261
2014/0345814 A1 * 11/2014 Bar-lev ..... A47H 15/02 160/333

* cited by examiner

SYSTEM AND METHOD FOR SUPPORTING A PRIVACY CURTAIN INCLUDING A SWING ARM WALL MOUNT AND END STOP CAP SUPPORT

DESCRIPTION OF THE RELATED ART

Currently, there are numerous commercial solutions for hanging curtains, drapes, or other materials (referred to as "hanging material") for use as a room divider, to create an enclosed space, or otherwise provide privacy in various applications. The hanging material may comprise any type of textiles, fabrics, cloths, or other flexible materials. Depending on the particular application, the hanging material may be referred to as a cubicle curtain, a hospital curtain, a privacy curtain, a shower curtain, or more generally as a curtain or drape (collectively referred to as "privacy curtains").

For example, hanging movable curtain systems are commonly used in nursing homes, extended care facilities, doctor offices, and other medical treatment facilities to provide patient privacy. The privacy curtains are typically hung using a track system. A track comprising an extruded aluminum or other channel may be attached to a conventional or dropped ceiling, which forms a path around the desired privacy area. Alternatively, the track may be coupled/fastened to a wall, such as, but not limited to, dry-wall.

A typical ceiling-mounted track and curtain system employs a series of rollers or gliders that move within the track. A hook may be attached to each roller with, for example, a chain. To drape the privacy curtain around the area defined by the track, each hook is attached to a series of grommets disposed on an upper portion of the privacy curtain. After the hooks have been attached to the grommets, the privacy curtain hangs from the ceiling-mounted track. An individual may pull the privacy curtain to slide it along the track and thereby open and close the privacy area.

Despite their widespread use and commercial success, ceiling-mounted track and curtain systems have many disadvantages. The ceiling-mounted track must generally follow a path that does not block ceiling obstacles (e.g., lights, vents, fire sprinklers, etc.), which may limit the location for optimal use of the rooms and increase custom installation costs. Furthermore, these types of systems may be difficult to install, use, and maintain. Due to the height of the ceiling-mounted track, it may be difficult to repair and clean the track system. Furthermore, a ladder may be required to take down the privacy curtain for maintenance, replacement, and/or cleaning. Because privacy curtains tend to be large in height and length and, therefore, relatively heavy, they can be very cumbersome to hang and take down.

Existing track designs typically use entry and exit points at one or both ends of the track for insertion and removal of the rollers and the curtain. For example, if one roller breaks in the sequence of rollers, all the rollers and the entire curtain up to that point need to be removed from the track in order to replace the broken roller. As shown in the art, the rollers may have a relatively short life span due to buildup of materials within the track system. When one or more rollers begin to malfunction, the privacy curtain may no longer smoothly traverse the track, which may cause the privacy curtain to catch or bind and lead to tearing of the hanging material.

Another problem with existing curtain hanging systems is that the hook-to-grommet method tends to fail when hooks are not correctly installed through the grommets. Improperly installed hooks may cause sagging of the hanging material, which can lead to an installer inadvertently failing to connect a hook to the corresponding grommet. In such cases, the privacy curtain may get caught in the track and lock.

Another problem with existing curtain hanging systems is that they often can obstruct doors and corresponding doorways. That is, with ceiling mounted systems, such systems are often difficult to take down and/or dismantle if large objects such as medical equipment must be moved into a room through a doorway.

Accordingly, despite the widespread availability and commercial success of privacy curtains, there remains a need in the art for improved systems, methods, and devices for attaching and/or supporting privacy curtains.

SUMMARY OF THE DISCLOSURE

Briefly, the present disclosure is related to a system and method for supporting a privacy curtain that includes a swing arm wall mount, tubular swing arm, a swing arm end stop cap and end stop cap support attached to the wall. The swing arm wall mount and end stop cap support can be used with a curtain support & swivel assembly that couples to the privacy curtain. The swing arm wall mount system is designed to work with both a left and right opening door within a wall, where the swing arm can be rotated/flipped so it swings in an opposite direction relative to a right or left opening door.

Specifically, a system and method for supporting a privacy curtain may include a swing arm wall mount and a tubular swing arm, a swing arm end stop cap and wall mounted end stop cap support. The wall mounted swing arm support may be coupled to the tubular swing arm and the end stop cap on the end of the swing arm. The end stop cap may engage the end stop cap support when the swing arm is in a closed position. The swing arm wall mount allows the swing arm to rotate when the swing arm is in an open position and when the swing arm end stop cap is not engaged with the end stop cap support.

The end stop cap engages the end stop cap support when the swing arm is in the closed position. And the end stop cap does not engage the end stop cap support when the swing arm is in an open position. The swing arm wall mount may comprise of a pin at one end, wherein the pin engages the swing arm wall mount.

The pin may engage a pin support member that is part of the swing arm wall mount. A privacy curtain may be suspended from the swing arm. At least one curtain support and swivel assembly may be used to couple the privacy curtain to the swing arm.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

In the Figures, like reference numerals refer to like parts throughout the various views unless otherwise indicated. For reference numerals with letter character designations such as "102A" or "102B", the letter character designations may differentiate two like parts or elements present in the same Figure. Letter character designations for reference numerals may be omitted when it is intended that a reference numeral encompass all parts having the same reference numeral in all Figures.

DETAILED DESCRIPTION

The term "exemplary" is used herein to mean "serving as an example, instance, or illustration." Any aspect described herein as "exemplary" is not necessarily to be construed as preferred or advantageous over other aspects.

Figure 1:
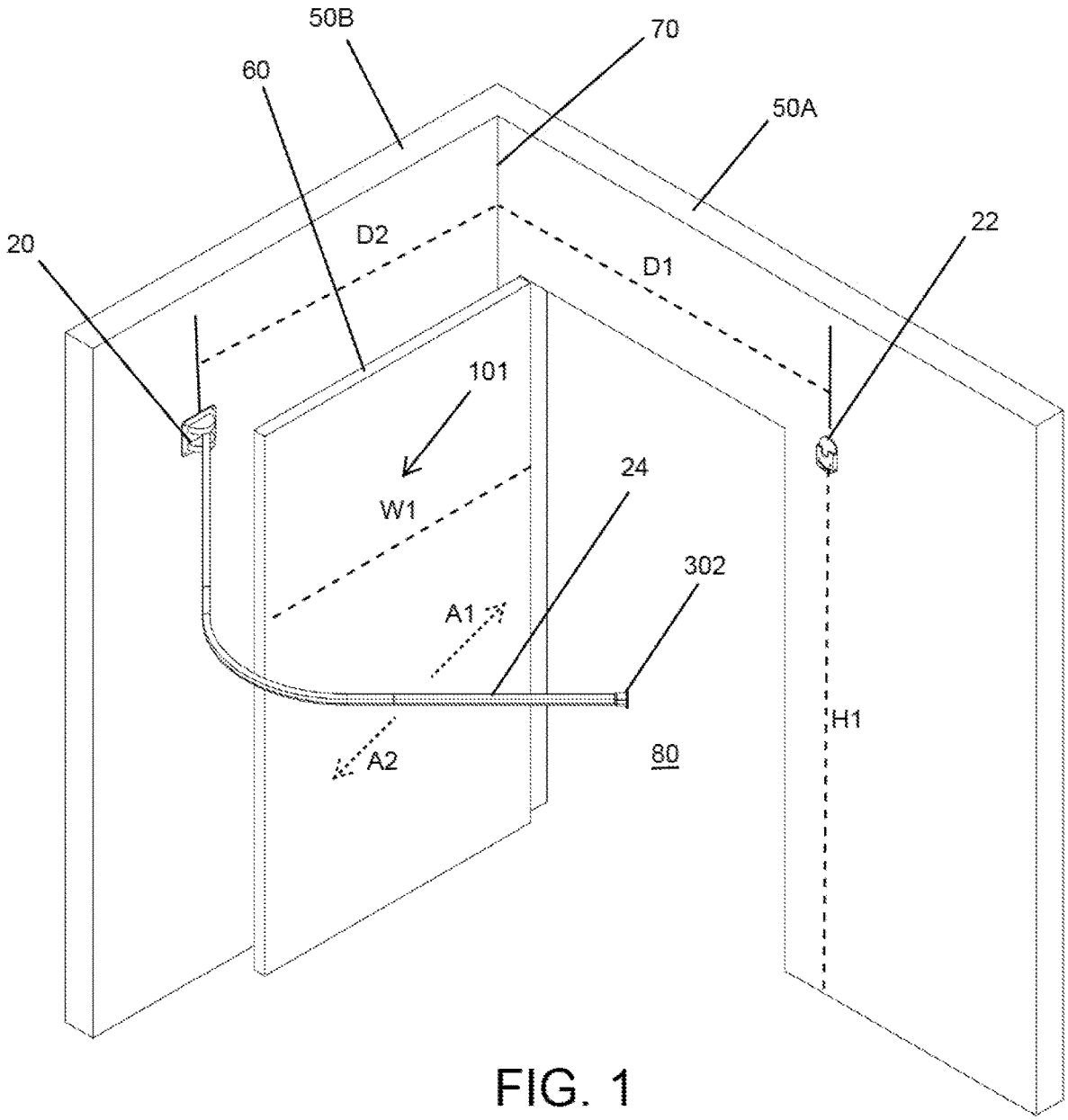
FIG. 1 illustrates a side perspective view of a system for providing a swing arm wall mount, tubular swing arm, end stop cap and end stop cap support where the system is in an open position.

Referring now to the drawings, wherein the showings are for purposes of illustrating certain exemplary embodiments of the present disclosure only, and not for purposes of limiting the same, FIG. 1A illustrates a view of a system 101 for providing a swing arm wall mount 20 and end stop 22, where the system 101 of FIG. 1 is in an open position. The system 101 is in an open position because the tubular track 24 and end stop cap 302 is not coupled to/is disconnected from the end stop cap support 22. The end stop cap support 22 receives the end stop cap 302 when the system 101 is placed in a closed position (See FIG. 2 for the closed position of the system 101).

The swing arm wall mount 20 functions as a hinge so that the tubular track 24 may rotate/move around the mount 20 as shown by dashed directional arrows A1 & A2 of FIG. 1. The wall mount 20 and end stop cap support 22 may be secured to two walls & 50B, where these two walls 50A & 50B may form about a ninety degree angle relative to each other. Generally, relative to the corner 70 formed by the two walls 50A & both the wall mount 20 and end stop cap support 22 may be positioned at a distance D1 & D2 which are slightly greater than a width W1 of a door 60 (i.e. D1 & D2>W1).

Both the end stop cap support 22 and wall mount 20 may be positioned above the floor at a height H1 which is generally a little less or equal to the height of the door With these relative spacings/relative dimensions, the door 60 may open towards a privacy curtain 604 (see FIG. 12) supported by tubular track 24, without interfering and/or contacting the privacy curtain 604.

It is noted that the two walls 50A, 50B may also form angles less than or greater than ninety-degrees without departing from the scope of this disclosure. The tubular track 24 may need to be increased or decreased in its relative length depending upon the angle formed by the two walls 50A, 50B (i.e. depending if the angle is acute or obtuse).

The wall mount 20 allows the tubular track 24 to be separated from the end stop cap support 22 when it is necessary to move the privacy curtain 604 and or tubular track 24 significantly far/distanced from/away from the door 60 (i.e. when moving bulky objects into a room that may have heights much greater>>than H1, such as, but not limited to furniture, medical equipment, etc. that may enter through the doorway 80.) That is, the tubular track 24 may be pushed out of the way in the direction of directional arrow A2 in order to move the track 24 away from the door 60, as needed, such that the track 24 and/or the privacy curtain 604 (see FIG. 12) are moved away from the door 60 and doorway 80.

Figure 2:
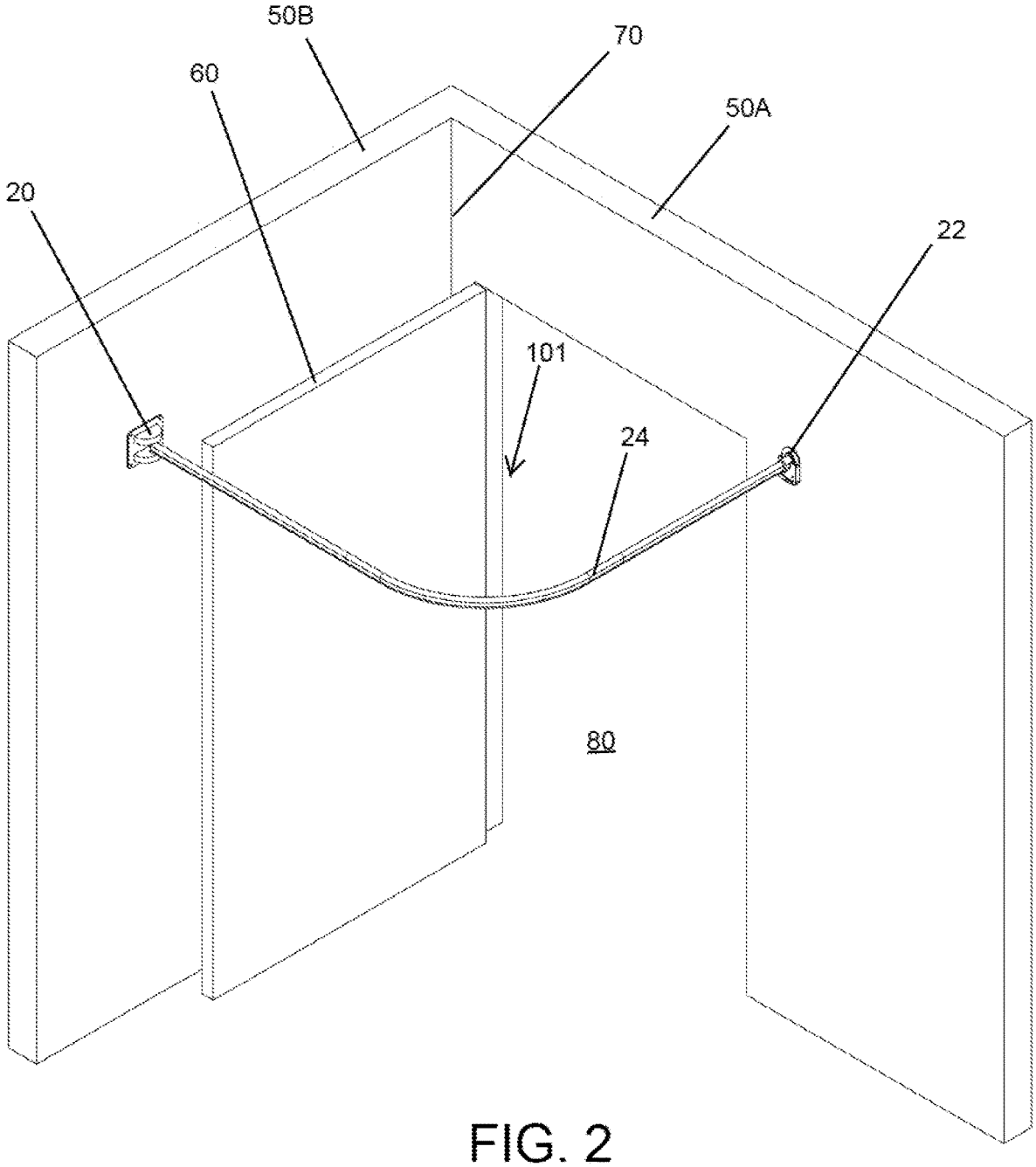
FIG. 2 illustrates a side perspective view of the system of FIG. 1 for providing a swing arm wall mount and end stop cap support, where the system 101 of FIG. 2 is now in a closed position relative to the open position show in FIG. 1.

Referring now to FIG. 2, this figure illustrates a side perspective view of the system 101 of FIG. 1 for providing a swing arm wall mount 20 and end stop cap support 22, where the system 101 of FIG. 2 is now in a closed position relative to the "open" position illustrated in FIG. 1. The system 101 is in a closed position because the tubular track 24 is now coupled to/is connected to the end stop support 22. The system 101 may work when the door 60 is hinged to the second wall 50B (not shown). As illustrated in FIGS. 1-2, the door 60 is hinged to the first wall 50A.

In other words, the door 60 could be present in/hinged to the second wall 50B (not shown). In that situation/setup where door 60 is hinged to the second wall 50B (not shown), the end stop support 22 could be moved from the first wall 50A to the second wall 50B, and the arm wall mount 20 may be moved from the second wall 50B to the first wall 50A. The tubular track 24 would then be flipped so that its hinged/pinned end would fit into the arm wall mount 20. As noted above, a privacy curtain 604 (see FIG. 12) is generally hung/suspended from the tubular track 24, so that the privacy curtain 604 may provide some level of "privacy" even when the door 60 is opened relative to its doorway 80.

While the system 101 works well with a door 60, in other exemplary embodiments (not illustrated), the system 101 may work well with just a corner 70 formed by two walls and without any door 60 in either wall 50A/B. For example, if a privacy curtain 604 (see FIG. 12) was needed to cover and/or block equipment/furniture placed in a corner 70 of a room, then the system 101 could be employed in this situation where no door is present in either wall 50A, 50B forming the corner 70 of a room.

Figure 3:
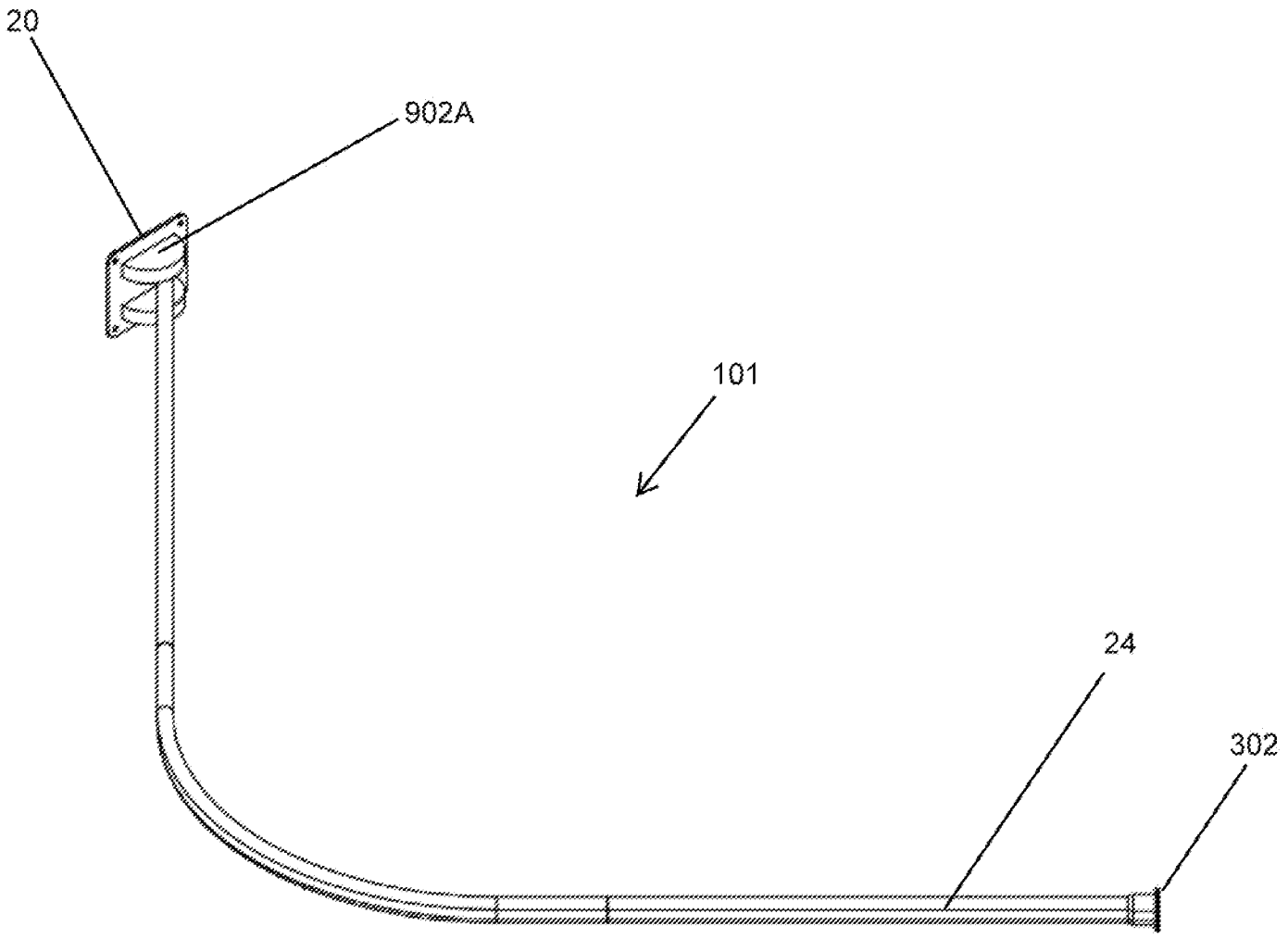
FIG. 3 illustrates an enlarged, side perspective view of the system of FIG. 1 for providing swing arm wall mount and end stop cap support, where the system is in an open position and is thus illustrated without an end stop cap support.

FIG. 3 illustrates an enlarged, side perspective view of the system 101 of FIG. 1 for providing swing arm wall mount 20 and end stop cap 302, where the system 101 is in an open position and is thus illustrated without an end stop cap support 22. When the end stop cap 302 is not coupled to the end stop cap support 22 (See FIG. 2), the tubular track 24 (or "swing arm") is free to rotate around the swing arm wall mount 20. The swing arm wall mount 20 functions as a hinge for the tubular track or swing arm 24. The wall mount 20 includes a first pin support 902A (see FIG. 4) which helps provide the "hinge" function for the mount 20. Further details about the wall mount 20 will be described below in connection with FIGS. 9-10.

Figure 4:
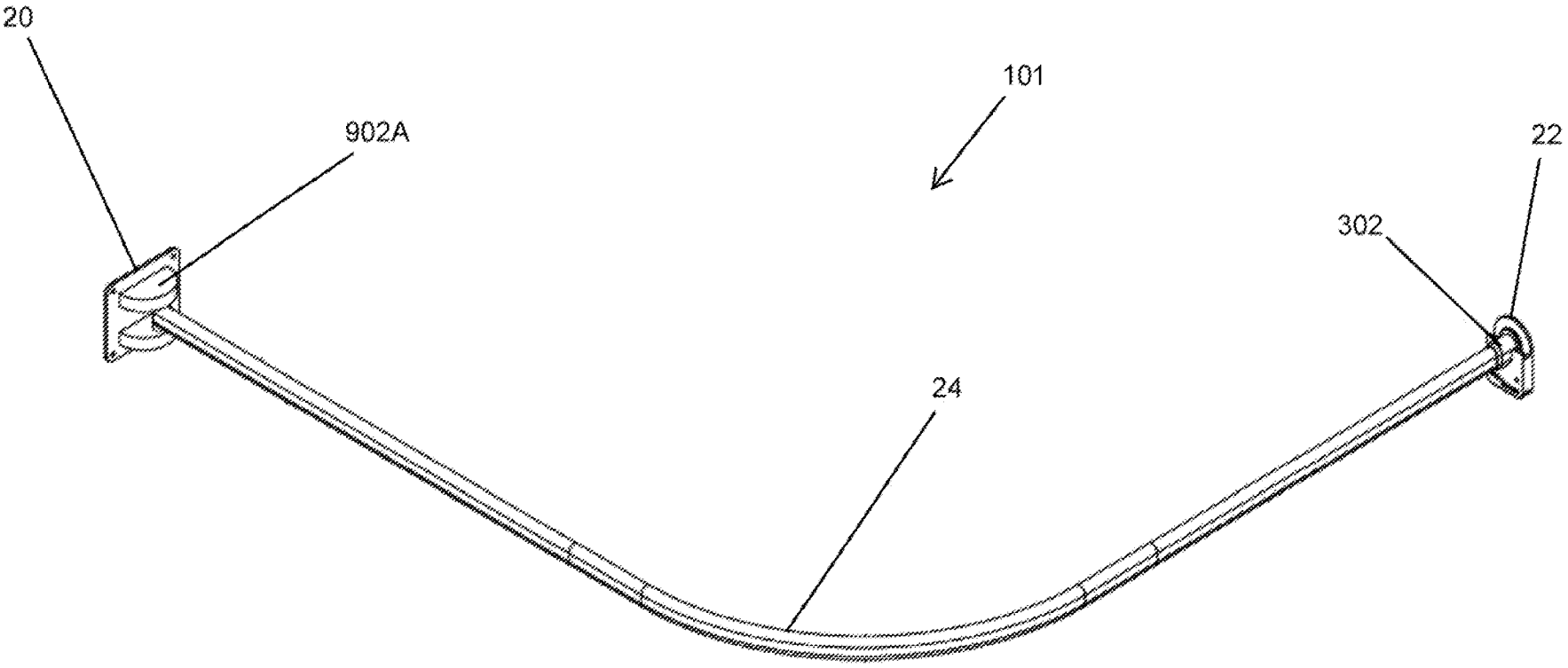
FIG. 4 illustrates an enlarged, side perspective view of the system of FIG. 2 for providing swing arm wall mount and end stop cap support, where the system is in a closed position and thus has end stop cap support.

Referring now to FIG. 4, this figure illustrates an enlarged, side perspective view of the system 101 of FIG. 2 for providing swing arm wall mount 20 and end stop cap support 22, where the system 101 is in a closed position and thus has the end stop cap support 22. In this figure, the end stop cap 302 of the tubular track or swing arm 24 couples with/mates with/engages with the end stop cap support 22.

As noted previously, while the end stop cap support 22 is illustrated on the right side of FIG. 4 and the swing arm wall mount 20 is illustrated on the left side of FIG. 4, the end stop cap support 22 can be positioned on the left side of the page and the wall mount similarly may be positioned on the right side of the page. In that situation (wall mount on right and end stop cap support 22 on the left side of the page—opposite to what is illustrated in FIG. 4), the tubular track 24 may be flipped/rotated upside down so that its end with integral pin 802 (see FIGS. 8 & 10) mates with the wall mount 20.

Figure 5:
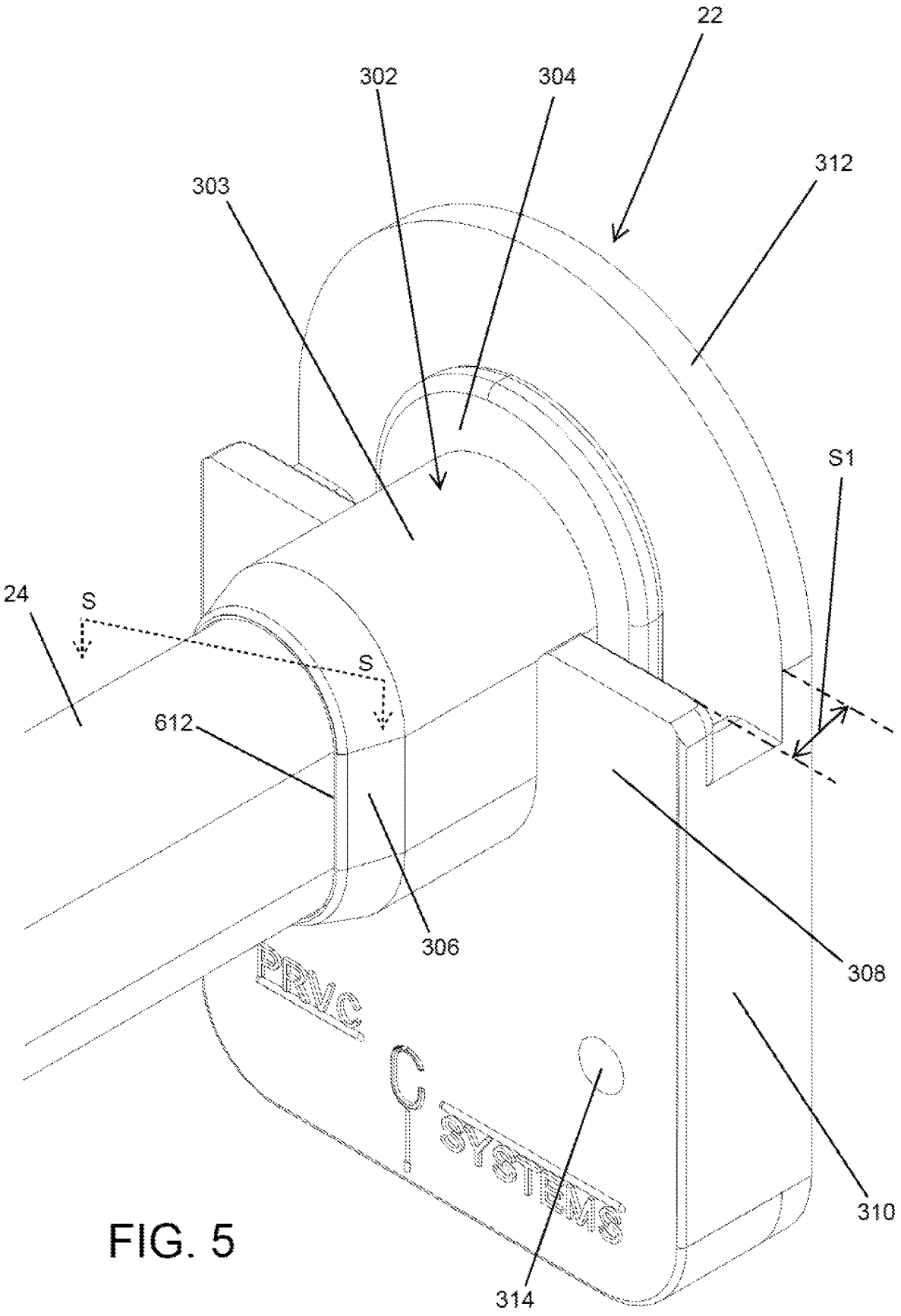
FIG. 5 illustrates a close-up side, perspective view of the end stop cap of the swing arm/tubular track mating with the end stop cap support.

Referring now to FIG. 5, this figure illustrates a close-up side, perspective view of the end stop cap 302 of the swing arm/tubular track 24 mating with the end stop cap support 22. In this view, further details/elements of the end stop cap support 22 are visible. Specifically, the end stop cap support 22 may include a wall facing portion 312, a side wall 310, and a front wall 308 which mates with the end stop cap 302 of the tubular track 24. The end stop cap 302 may include a stop end engaging portion 304. According to the exemplary embodiment illustrated in FIG. 5, the stop cap end engaging portion 304 of the end stop cap 302 may comprise an elliptical geometry. However, other geometries for the stop end engaging portion 304 are possible and are included within the scope of this disclosure.

The end stop cap 302 may further comprise a mid-section 303 which is between the stop end engaging portion 304 and a track end engaging portion 306. The track end engaging portion 306 may comprise an angled portion/tapered portion that directly contacts the tubular track 24.

The end stop cap 302 generally has cross-sections the mirror the cross-sectional geometry of the tubular track 24. That is, the stop cap end engaging portion 304, the mid-section 303, and the track end engaging portion 306 may all have cross-sectional geometries taken along the sectional line S-S that match the cross-sectional geometry of the tubular track 24.

In the exemplary embodiment illustrated in FIG. 5, the tubular track 24 has an elliptical cross-sectional geometry. And it follows, that the stop end engaging portion 304, the mid-section 303, and the track end engaging portion 306 also have elliptical cross-sectional geometries. However, other geometries for the cross-sections are possible and are included within the scope of this disclosure. Other cross-sectional geometries include, but are not limited to, square, rectangular, circular, triangular, pentagonal, hexagonal, octagonal, and any polygonal shape.

The track end engaging portion 306 of the end stop cap 302 may further include an edge 612. This edge 612 may directly contact and couple with the tubular track 24.

The wall facing portion 312 and front wall 308 of the end stop 22 may define a spacing S1 between the two elements such that stop end engaging portion 304 of the end cap 302 may fit between the wall facing portion 312 and front wall 308 of the end stop cap support 22. Generally, this spacing S1 is greater in size relative to the thickness of the stop end engaging portion 304.

Figure 7:
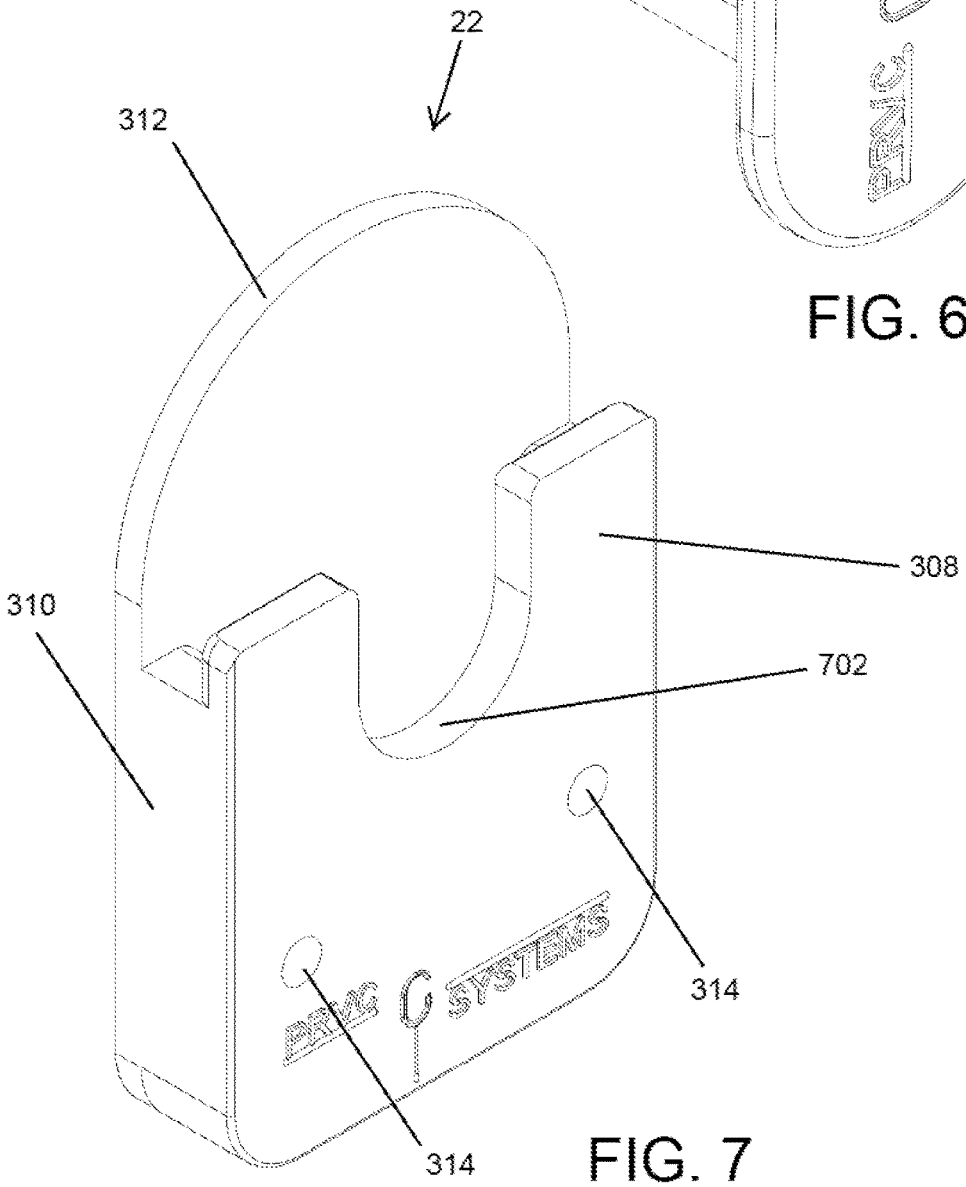
FIG. 7 illustrates an enlarged, side, perspective view of the end stop cap support illustrated in FIGS. 1-5.

The end stop cap support 22 may further comprise two apertures (i.e. holes) 314 (See FIG. 7 illustrating both apertures 314) for mounting the end stop cap support 22 to a wall 50. That is, a fastener (not illustrated) may penetrate the front wall 308 and wall facing portion 312 through each aperture 314. An aperture 314 is present in each front wall 308 and each wall facing portion 312. Exemplary fasteners (not illustrated) include, but not limited to, screws, nails, bolts, rivets, etc.

Figure 6:
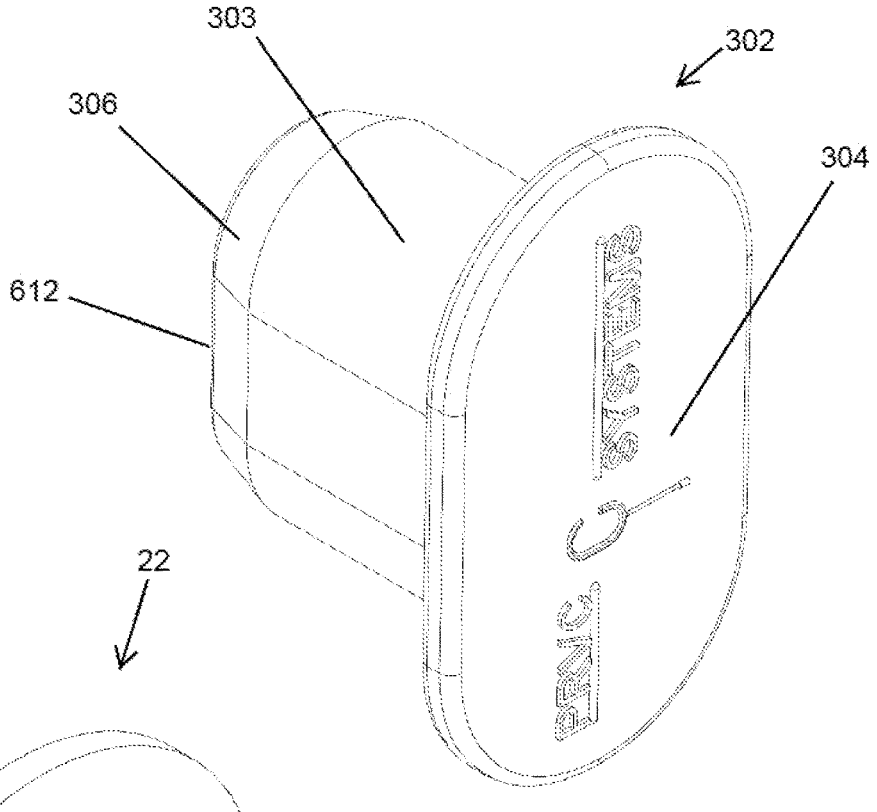
FIG. 6 illustrates a side perspective view of the end stop cap FIGS. 1-5 which fits on one end of the tubular track.

Referring now to FIG. 6, this figure illustrates a side perspective view of the end stop cap 302 which fits on one end of the tubular track 24. As noted previously, the end stop cap 302 may comprise the stop end engaging portion 304, the mid-section 303, and the track end engaging portion 306. The stop end engaging portion 304 will generally have a cross-sectional area/profile/perimeter which is significantly greater than the cross-sectional area/profile/perimeter of the tubular track 24.

Meanwhile, the mid-section 303 of the end cap 302 may have a cross-sectional area/profile/perimeter that is greater than the cross-sectional area/profile/perimeter of the tubular track 24, but less than the cross-sectional area/profile/perimeter of the stop end engaging portion 304.

And the track end engaging portion 304 may comprise an edge 612 that directly couples with the tubular track 24. The edge 612 may comprise a perimeter that is substantially equal and/or matches the outer perimeter geometry of the tubular track 24 (See FIG. 5).

Referring now to FIG. 7, this figure illustrates an enlarged, side, perspective view of the end stop cap support 22 illustrated in FIGS. 1-5. The end stop 22 comprises a mid-section receiving portion 702. The mid-section receiving portion 702 receives the mid-section 303 of the end stop cap 302 of FIG. 6. The mid-section receiving portion 702 may comprise a recess within the front wall 308 of the end stop.

As illustrated in FIG. 7, the mid-section receiving portion 702 may comprise a U-shaped geometry that mirrors a portion of the geometry of the perimeter of the tubular track 24. Generally, the geometry of the mid-section receiving portion 702 of the front wall 308 will mirror a portion of the geometry of the perimeter of the tubular track 24 as understood by one of ordinary skill in the art.

Figure 8:
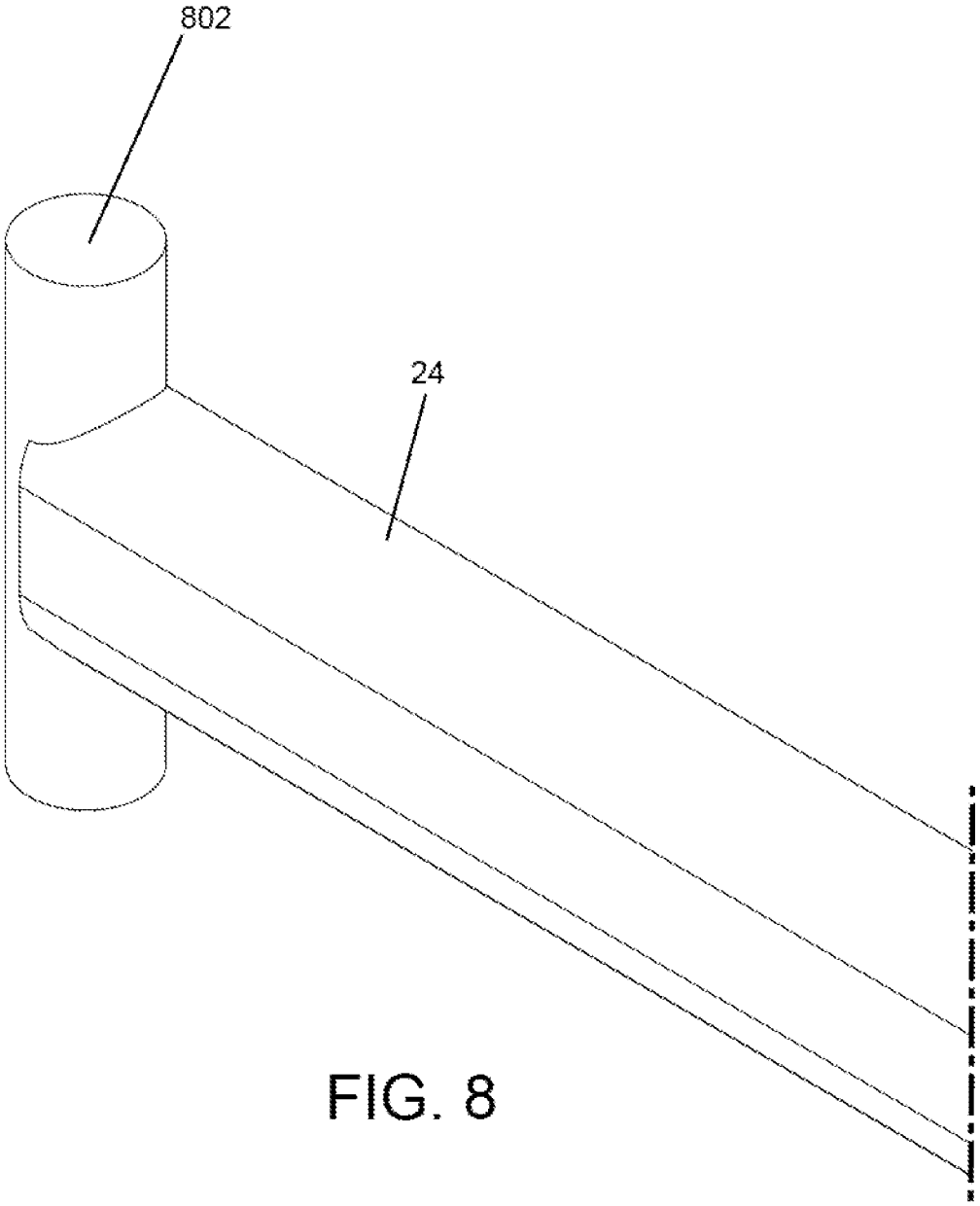
FIG. 8 illustrates an enlarged, side, perspective view of one end of the tubular track illustrated in FIGS. 1-5.
Figure 10:
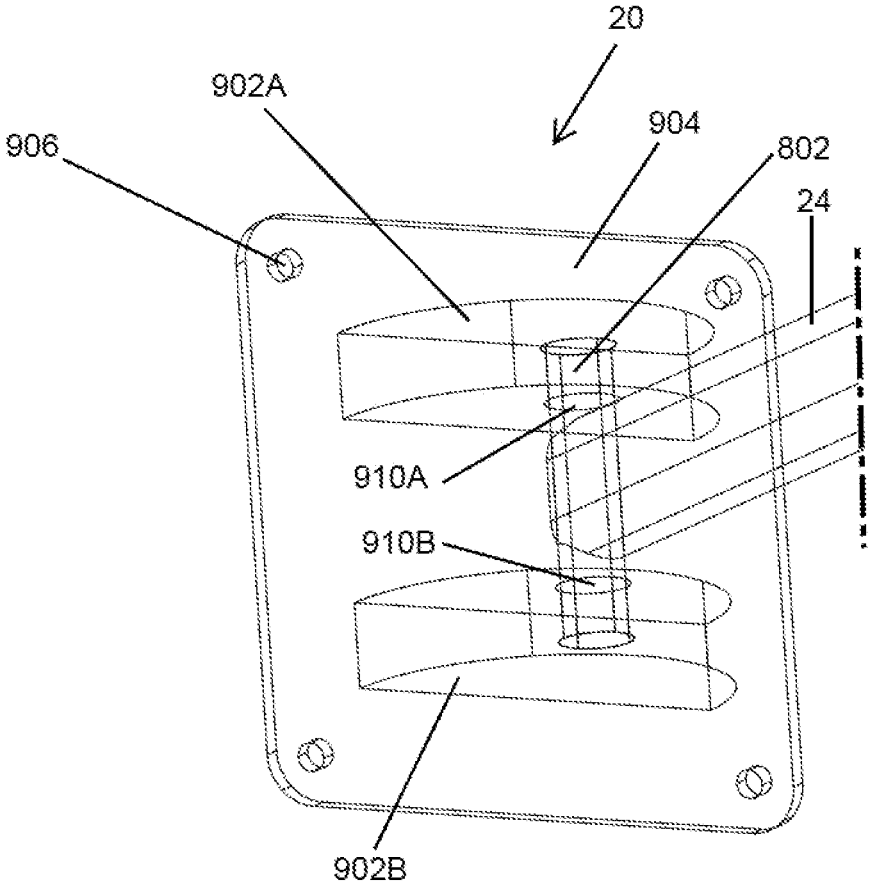
FIG. 10 illustrates an enlarged, rear-side, perspective view of the swing arm wall mount as shown in FIG. 9.
Figure 11:
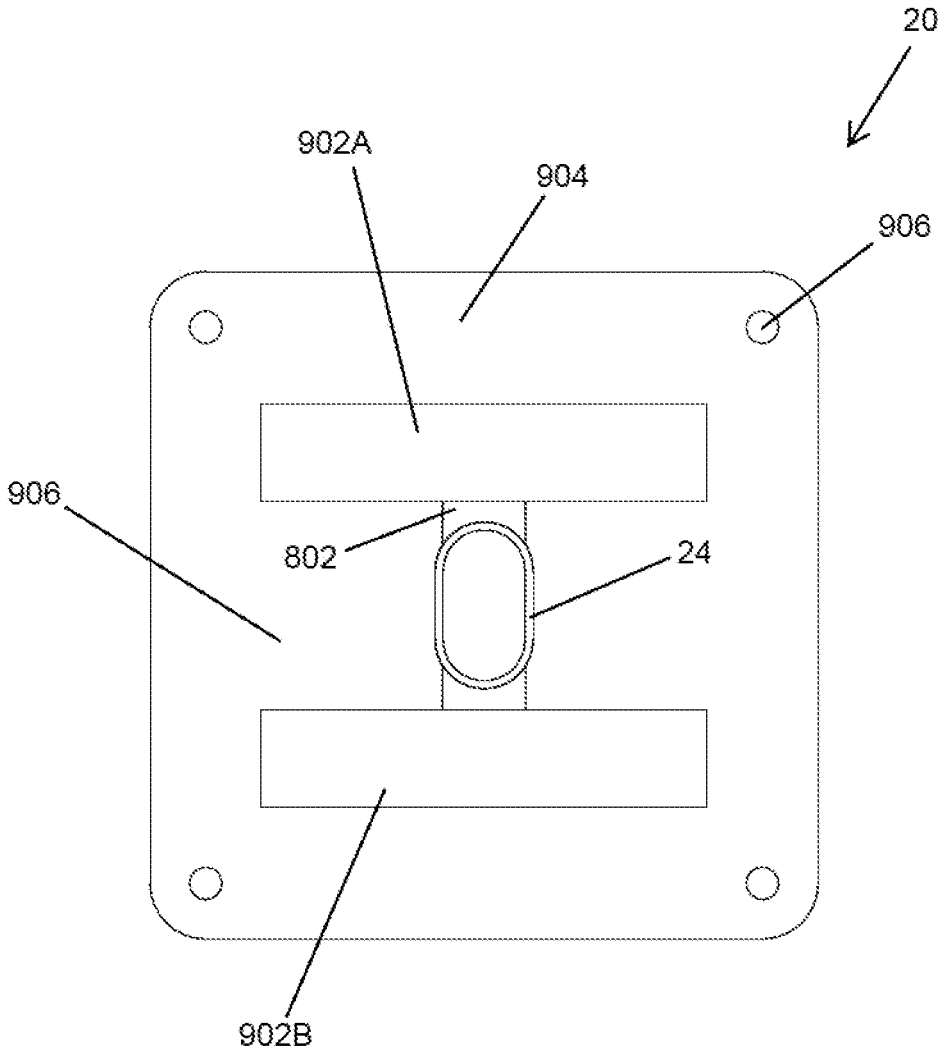
FIG. 11 illustrates an enlarged front view of the swing arm wall mount illustrated in FIGS. 1-4 & FIGS. 9-10.

Referring now to FIG. 8, this figure illustrates an enlarged, side, perspective view of one end of the tubular track 24 illustrated in FIGS. 1-5. Specifically, one end of the tubular track 24 may comprise an integral pin 802. This integral pin 802 couples with the swing arm wall mount 20 as will be described below and which is illustrated in FIGS. 9-11.

The integral pin 802 is formed such that it directly couples with the tubular track 24. According to one exemplary embodiment, the integral pin 802 and track 24 are formed by welding the aluminum pin 802 to the hollow, aluminum tubular track 24 three-hundred sixty degrees around the tubular track 24. The integral pin 802 may be made from solid aluminum, or it can be hollow aluminum.

Figure 9:
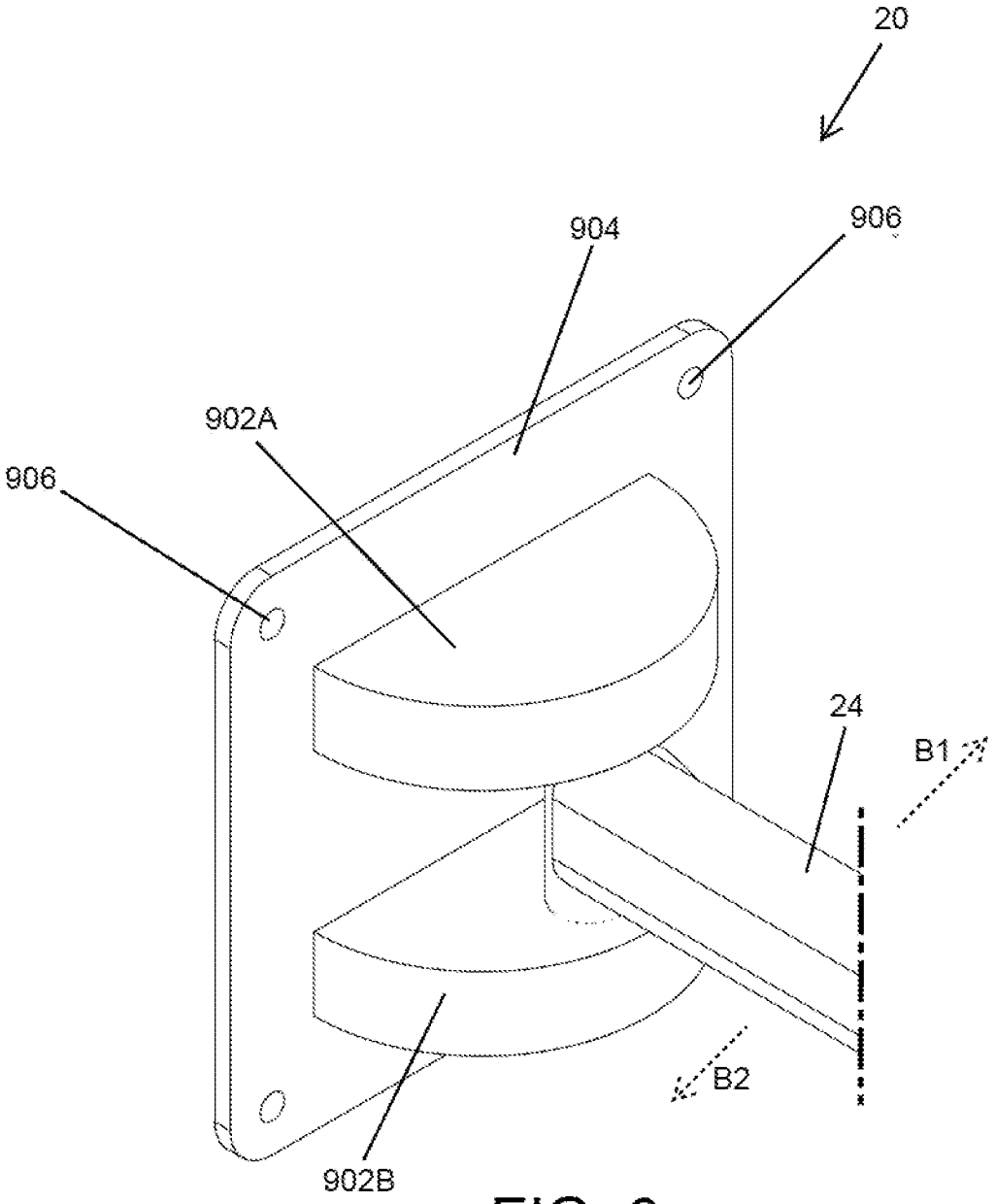
FIG. 9 illustrates an enlarged, side, perspective view of the swing arm wall mount of FIGS. 1-4 and a portion of the tubular track.

Referring now to FIG. 9, this figure illustrates an enlarged, side, perspective view of the swing arm wall mount 20 of FIGS. 1-4 and a portion of the tubular track 24. The wall mount 20 may comprise a first pin support 902A, a second pin support 902B, and a wall contacting plate 904. The wall contacting plate 904 may include apertures 906 for receiving fasteners (not illustrated) such as, but not limited to, screws, nails, bolts, rivets, etc.

The first pin support 902A may receive and couple to a portion of the pin 802 (illustrated in FIG. 8, described above). Similarly, the second pin support 902B may receive and couple to a portion of the pin 802 (illustrated in FIG. 8, described above). According to the exemplary embodiment illustrated in FIG. 9, each pin support 902 may comprise a semi-circular shaped geometry. Other shapes for each pin support 902 are possible and are included within the scope of this disclosure.

The pin supports 902 hold the pin 802 in place such that the tubular track 24 may rotate around the pin 802 as shown by directional arrows B1 & B2 in FIG. 9. As noted above the tubular track 24 is free to rotate around the pin 802 when the end cap 302 of the track 24 is not coupled to the end stop 22 as shown in FIG. 1 discussed above.

Referring now to FIG. 10, this figure illustrates an enlarged, rear-side, perspective view of the swing arm wall mount 20 as shown in FIG. 9. In this figure, the internal structure of each pin support 902 is visible. Each pin support 902 has an aperture and corresponding recess that receives a portion of the pin 802.

Specifically, the aperture 910A of the first pin support 902A receives a first portion of the pin 802. Similarly, the aperture 910B of the second pin support 902B receives a second portion of the pin 802 so that the pin 802 may rotate within the first and second apertures 910A, 910B.

Referring now to FIG. 11, this figure illustrates an enlarged front view of the swing arm wall mount 20 illustrated in FIGS. 1-4 & FIGS. 9-10. In this figure, the tubular track or swing arm 24 is illustrated in cross-section, where the tubular track 24 has a substantially elliptical cross-sectional geometry. As noted previously, other cross-sectional geometries for the tubular track 24 are possible and are included within the scope of this disclosure.

Figure 12:
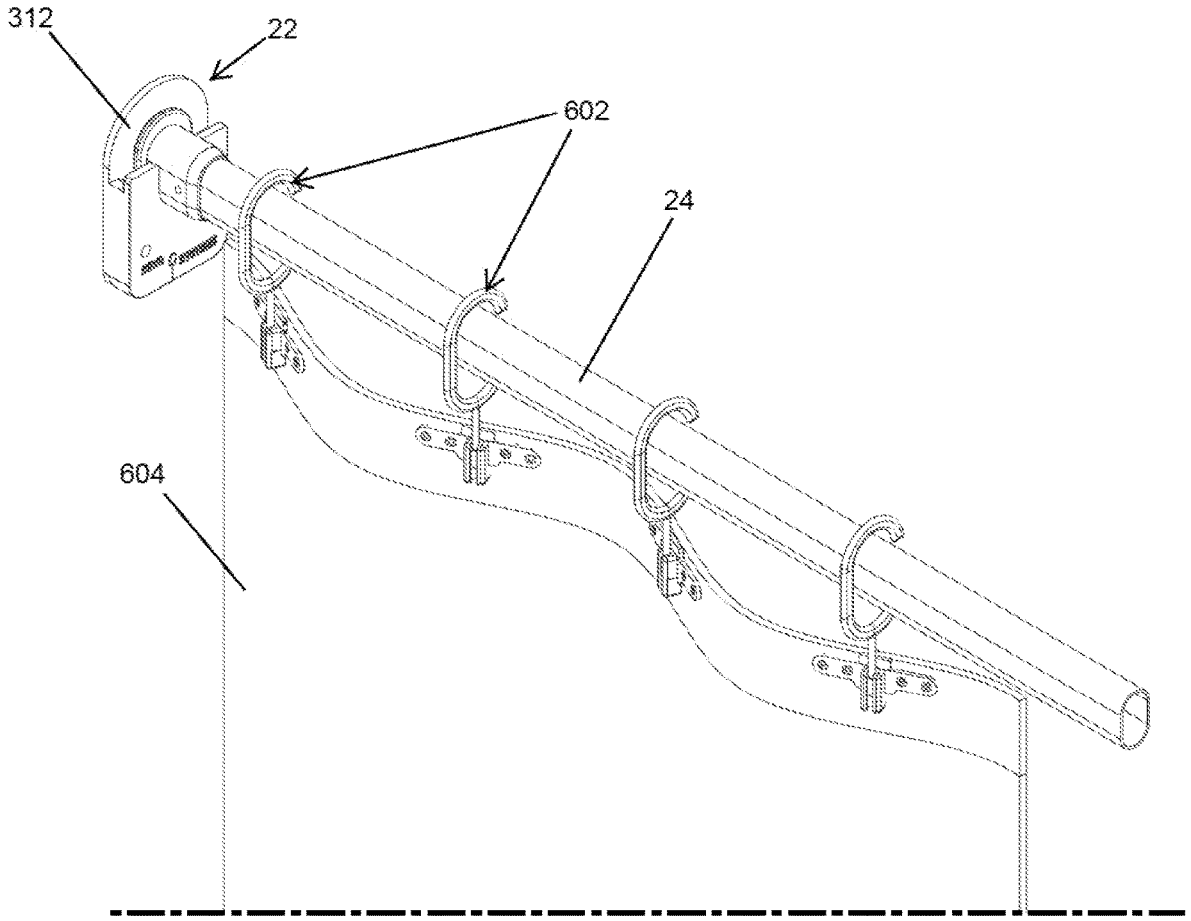
FIG. 12 illustrates a side perspective view the tubular track coupled to the end stop cap support and supporting a privacy curtain according to one exemplary embodiment.

Referring now to FIG. 12, this figure illustrates a side perspective view the tubular track 24 coupled to the end stop 22 and supporting a privacy curtain 604 according to one exemplary embodiment. The privacy curtain 604 may comprise a hanging material, such as a curtain or drape made from flexible planar materials. The hanging material may comprise any type of textiles, fabrics, cloths, or other flexible materials. Depending on the particular application, the hanging material may be referred to as a cubicle curtain, a hospital curtain, a privacy curtain, a shower curtain, or more generally as a curtain or drape (collectively referred to as "privacy curtains 604").

The privacy curtain may couple with a curtain support and swivel assembly 602. The curtain support and swivel assembly 602 is further described in commonly owned U.S. Pat. No. 10,264,908 issued on Apr. 23, 2019, the entire contents of which are incorporated by reference. The curtain support and swivel assembly members 602 allow the privacy curtain 604 to slide along the track 24.

Figure 13:
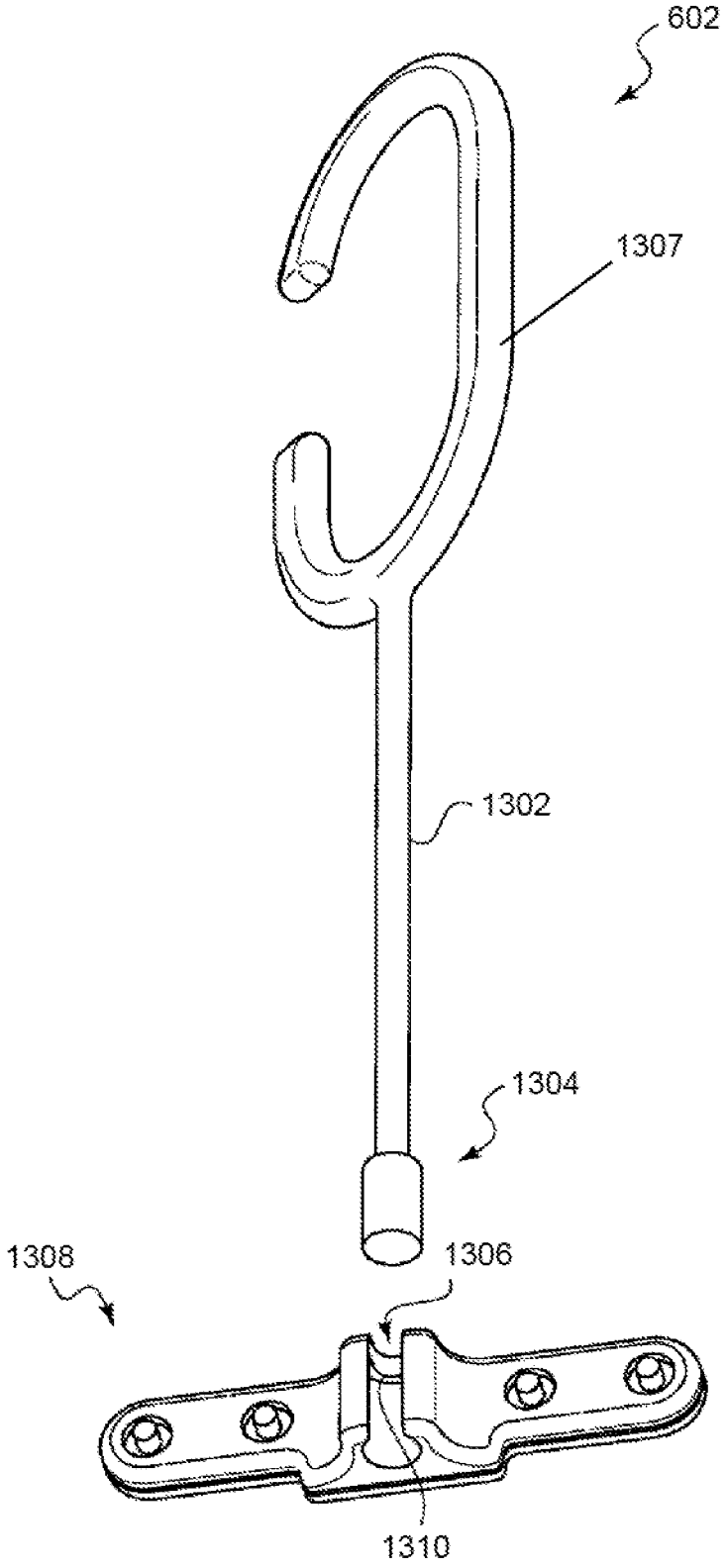
FIG. 13 illustrates further details of the curtain support and swivel assembly of FIG. 12 that couples with the track for supporting a privacy curtain.

Referring now to FIG. 13, this figure illustrates further details of the curtain support and swivel assembly 602 that couples with the track 24 for supporting a privacy curtain 604. As noted previously, the curtain support and swivel assembly 602 is further described in commonly owned U.S. Pat. No. 10,264,908 issued on Apr. 23, 2019, the entire contents of which are incorporated by reference.

The curtain support & swivel assembly 602 may include a support rod 1302, a stop member 1304, a longitudinal opening 1306, a curtain attachment member 1308, and a lip 1310 disposed within the longitudinal opening 1306. A "C"-shaped hook portion 1307 may be present at an end section of the rod 1302 for coupling and receiving the tubular track 24.

Figure 14:
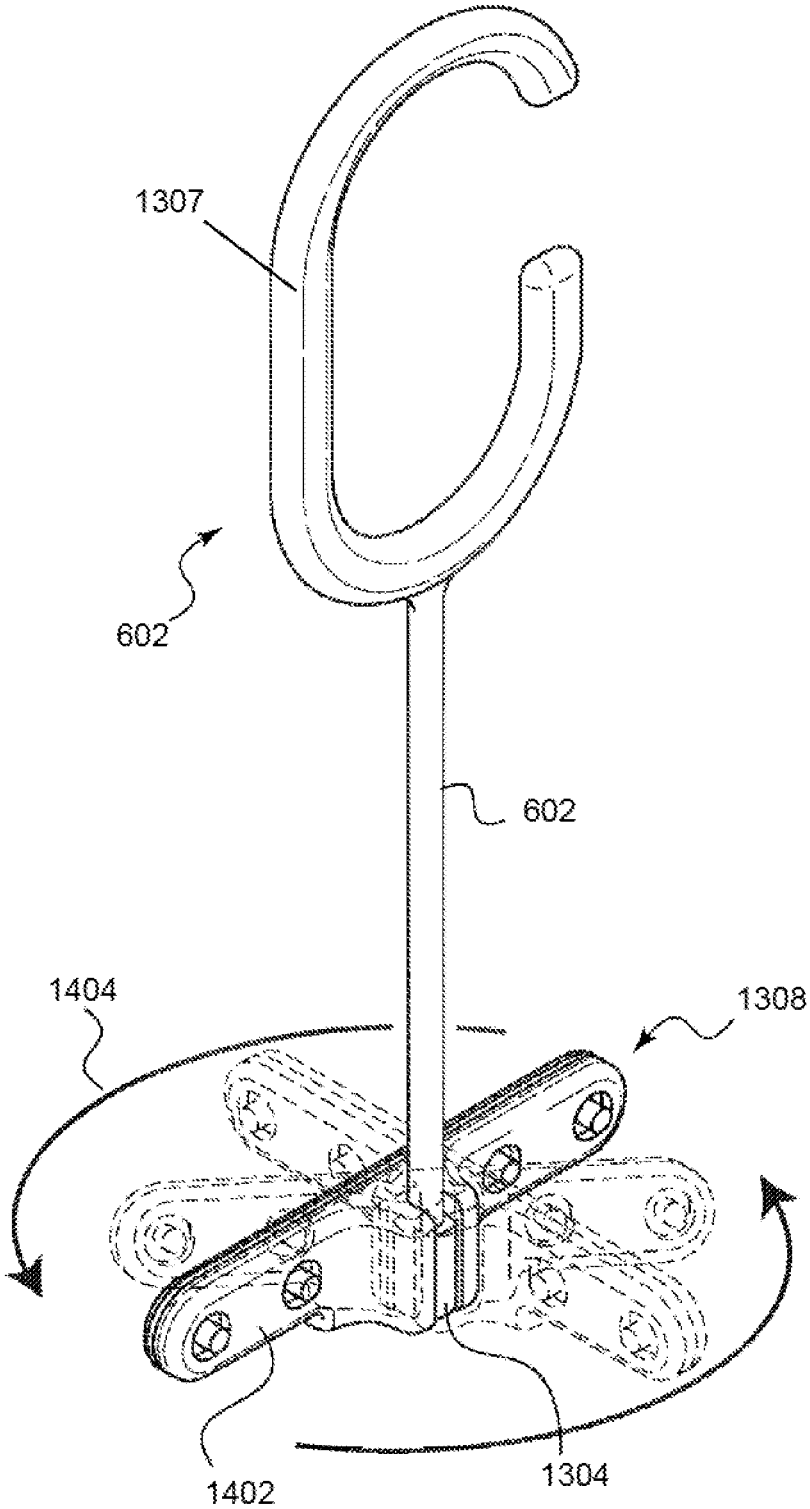
FIG. 14 illustrates coupling details for the curtain support and swivel assembly of FIG. 13 that couples with the track for supporting a privacy curtain and which allows the privacy curtain to swivel.

Referring now to FIG. 14, this figure illustrates coupling details for the curtain support and swivel assembly 602 of FIG. 13 that couples with the track 24 for supporting a privacy curtain 604 and which allows the privacy curtain 604 (see FIG. 12) to swivel. The stop member 1304 of the swivel assembly 602 couples to a curtain support plate 402 that has two members, where each member contacts a side of the privacy curtain 604. The curtain support plate 1402 is designed to rotate or swivel around the stop member 1304 as shown by directional arrows 1404. While support and swivel assembly members 602 are the preferred mechanical couplers for supporting the privacy curtain 604 from the tubular track (see FIG. 12), other privacy curtain support mechanisms are possible and are included within the scope of this disclosure.

As noted previously, the tubular track or swing arm 24 as well as the integral pin 802 may be made from metal, such as, but not limited to, aluminum. Other metals are possible and are included within the scope of this disclosure.

Meanwhile, other parts such as the pin supports 902, wall contacting plate 904, end stop cap 302, and end stop cap support 22 may be made from plastic. However, other materials and/or combinations of the materials noted above are possible and are included within the scope of this disclosure as understood by one of ordinary skill in the art.

Certain steps in an exemplary method described illustrated by the several drawing figures naturally precede others for the invention to function as described. However, the invention is not limited to the order of the steps described if such order or sequence does not alter the functionality of the system and method of the present disclosure. That is, it is recognized that some steps may be performed before, after, or parallel (substantially simultaneously with) other steps without departing from the scope and spirit of the invention.

Alternative embodiments for the system and method of the present disclosure will become apparent to one of ordinary skill in the art to which the invention pertains without departing from its spirit and scope. Therefore, although selected aspects have been illustrated and described in detail, it will be understood that various substitutions and alterations may be made therein without departing from the spirit and scope of the present invention, as defined by the following claims.

What is claimed is:

1. A system for supporting a privacy curtain comprising:

a swing arm wall mount;

a swing arm which is coupled to the swing arm wall mount; and an end stop support that engages the swing arm when the swing arm is in a closed position, the swing arm wall mount allowing the swing arm to rotate when the swing arm is in an open position and when the swing arm is not engaged with the end stop support;

the swing arm comprises an integral pin at one end, the pin comprising a top portion and a bottom portion;

the wall mount further comprising a first pin support having a first semi-circular shape;

the wall mount further comprising a second pin support having a second semi-circular shape;

the first pin support comprising a first circular aperture extending from a bottom surface of the first semi-circular shape for receiving the top portion of the pin;

the second pin support comprising a second circular aperture extending from a top surface of the second semi-circular shape for receiving the bottom portion of the pin;

wherein each of the first circular aperture and second circular aperture extend only partially through the respective pin support.

2. The system of claim 1, further comprising an end cap that couples to the swing arm.

3. The system of claim 2, wherein the end cap engages the end stop support when the swing arm is in the closed position.

4. The system of claim 3, wherein the end cap does not engage the end stop support when the swing arm is in an open position.

5. The system of claim 1, further comprising a privacy curtain coupled to the swing arm.

6. The system of claim 5, further comprising at least one curtain support and swivel assembly that couples the privacy curtain to the swing arm.

7. A system for supporting a privacy curtain comprising:

a swing arm wall mount;

a curved swing arm which is coupled to the swing arm wall mount;

a privacy curtain coupled to the curved swing arm; and an end stop support that engages the curved swing arm when the curved swing arm is in a closed position, the swing arm wall mount allowing the curved swing arm to rotate when the curved swing arm is in an open position and when the curved swing arm is not engaged with the end stop support;

the curved swing arm comprises an integral pin at one end, the pin comprising a top portion and a bottom portion;

the wall mount further comprising a first pin support having a first semi-circular shape;

the wall mount further comprising a second pin support having a second semi-circular shape;

the first pin support comprising a first circular aperture extending from a bottom surface of the first semi-circular shape for receiving the top portion of the pin;

the second pin support comprising a second circular aperture extending from a top surface of the second semi-circular shape for receiving the bottom portion of the pin;

wherein each of the first circular aperture and second circular aperture extend only partially through the respective pin support.

8. The system of claim 7, further comprising an end cap that couples to the curved swing arm.

9. The system of claim 8, wherein the end cap engages the end stop support when the curved swing arm is in the closed position.

10. The system of claim 9, wherein the end cap does not engage the end stop support when the curved swing arm is in an open position.

11. A system for supporting a privacy curtain comprising:

a first wall;

a second wall;

a swing arm wall mount coupled to the first wall;

a swing arm which is coupled to the swing arm wall mount;

a privacy curtain coupled the swing arm; and an end stop support coupled to the second wall that engages the swing arm when the swing arm is in a closed position, the swing arm wall mount allowing the swing arm to rotate when the swing arm is in an open position and when the swing arm is not engaged with the end stop support;

the swing arm comprises an integral pin at one end, the pin comprising a top portion and a bottom portion;

the wall mount further comprising a first pin support having a first semi-circular shape;

the wall mount further comprising a second pin support having a second semi-circular shape;

the first pin support comprising a first circular aperture extending from a bottom surface of the first semi-circular shape for receiving the top portion of the pin;

the second pin support comprising a second circular aperture extending from a top surface of the second semi-circular shape for receiving the bottom portion of the pin;

wherein each of the first circular aperture and second circular aperture extend only partially through the respective pin support.

12. The system of claim 11, further comprising an end cap that couples to the swing arm.

13. The system of claim 12, wherein the end cap engages the end stop support when the swing arm is in the closed position.

* * * * *